US009755351B1

(12) United States Patent
Nicholson

(10) Patent No.: US 9,755,351 B1
(45) Date of Patent: Sep. 5, 2017

(54) CONNECTOR ASSEMBLY COMPRISING ELECTRICAL FEEDTHROUGH WITH STRESS DECOUPLING

(71) Applicant: OneSubsea IP UK Limited, London (GB)

(72) Inventor: Joseph Allan Nicholson, Broughton-in-Furness (GB)

(73) Assignee: OneSubsea IP UK Limited, London (GB)

( * ) Notice: Subject to any disclaimer, the term of this patent is extended or adjusted under 35 U.S.C. 154(b) by 0 days.

(21) Appl. No.: 15/150,170

(22) Filed: May 9, 2016

(51) Int. Cl.
*H01R 13/512* (2006.01)
*H01R 13/52* (2006.01)

(52) U.S. Cl.
CPC ..... *H01R 13/521* (2013.01)

(58) Field of Classification Search
CPC H01R 13/111; H01R 13/213; H01R 2101/00; H01R 11/28; H01T 13/04
USPC ..... 439/750
See application file for complete search history.

(56) References Cited

U.S. PATENT DOCUMENTS 1,869,181 A * 7/1932 Beck ..... H04M 3/22 294/99.2
2,311,647 A * 2/1943 Doran ..... H01T 13/36 123/169 EL
2,487,098 A * 11/1949 Carington et al. ..... 338/220
2,832,941 A * 4/1958 Willis ..... H01R 13/111 439/693
3,435,387 A * 3/1969 Reinke ..... H01R 13/7197 333/183
3,550,064 A * 12/1970 Caller ..... H01R 9/0521 439/276
3,571,784 A * 3/1971 Naus ..... H01R 13/426 439/750
3,945,700 A * 3/1976 Didier ..... E21B 17/028 439/456
4,173,384 A * 11/1979 Phillips ..... H01R 24/42 439/448
4,614,392 A * 9/1986 Moore ..... H01R 13/5213 174/91
4,804,330 A * 2/1989 Makowski ..... H01R 13/533 174/18
5,344,337 A * 9/1994 Ritter ..... H01R 13/533 439/447
6,910,910 B2 * 6/2005 Cairns ..... G02B 6/3816 174/13
7,318,758 B2 * 1/2008 Haller ..... H01R 13/432 439/357
7,364,451 B2 * 4/2008 Ring ..... H01R 13/521 439/271
7,384,287 B2 * 6/2008 Hughes ..... H01H 9/085 439/181
7,520,768 B2 4/2009 Nicholson
7,718,899 B2 5/2010 Benestad et al.
(Continued)

*Primary Examiner* — Abdullah Riyami
*Assistant Examiner* — Vladimir Imas
(74) *Attorney, Agent, or Firm* — Chamberlain Hrdlicka

(57) ABSTRACT

A feedthrough for a connector system includes an insulator comprising a passage therethrough, a conductor pin located in the passage, and a pressure sleeve located between the insulator and the conductor pin. The pressure sleeve is coupled to the insulator and to the conductor pin, and the conductor pin is movable relative to the insulator under thermal or pressure expansion or contraction.

20 Claims, 2 Drawing Sheets

(56) References Cited

U.S. PATENT DOCUMENTS

| | | | | |
|---|---|---|---|---|
| 7,736,191 | B1 * | 6/2010 | Sochor | A61N 1/3752 439/668 |
| 7,794,256 | B1 * | 9/2010 | Sochor | H01R 13/025 439/289 |
| 8,162,684 | B1 * | 4/2012 | Sochor | A61N 1/3754 439/289 |
| 8,189,333 | B2 * | 5/2012 | Foster | H01R 13/035 361/690 |
| 8,283,579 | B2 * | 10/2012 | Lin | H02G 3/088 174/651 |
| 8,287,295 | B2 * | 10/2012 | Sivik | H02G 3/22 439/271 |
| 8,540,532 | B2 * | 9/2013 | Barnard | H01R 13/111 439/607.01 |
| 8,657,031 | B2 * | 2/2014 | Kononenko | B25F 5/00 173/176 |
| 8,708,727 | B2 | 4/2014 | Spahi et al. | |
| 9,413,148 | B2 * | 8/2016 | Sagdic | H01R 13/506 |
| 2010/0093231 | A1 * | 4/2010 | Lauermann | H01R 13/5205 439/852 |
| 2015/0111420 | A1 * | 4/2015 | Zillinger | E21B 43/123 439/521 |

* cited by examiner

CONNECTOR ASSEMBLY COMPRISING ELECTRICAL FEEDTHROUGH WITH STRESS DECOUPLING

This section is intended to provide relevant contextual information to facilitate a better understanding of the various aspects of the described embodiments. Accordingly, it should be understood that these statements are to be read in this light and not as admissions of prior art.

Hydrocarbon fluids such as oil and natural gas are obtained from a subterranean geologic formation, referred to as a reservoir, by drilling a well that penetrates a hydrocarbon-bearing formation. Once a wellbore is drilled, various forms of well completion components may be installed to control and enhance the efficiency of producing the various fluids from the reservoir. One piece of equipment that may be installed is an electric submersible pump (ESP). ESPs may be deployed in both subsea and non-subsea completions. ESPs are also provided with electric power as well as hydraulics, and the connection from the supply source is often made after the ESP is deployed (i.e., downhole).

Some reservoirs initially have high operational pressures in the range of 13,500 pounds per square inch (psi), which requires the pump system and wellheads be rated anywhere from 15,000 psi to 20,000 psi for operational pressure. To power the associated pumps, a subsea tree may need to have a connection system, such as a wet-mateable connector, capable of providing two megawatts (MW) of power through the tree system. There may also be large pressure differentials across the tree boundaries that must be handled over the lifetime (e.g., ten years) of the system/tree. In addition to being able to withstand high differential pressures, the penetration system (i.e., connector assembly) must be able to handle the effects of high temperature due to intrinsic bottom hole temperatures, heating from fluid pumping, and joule heating from electrical current. To do so, the connector assembly may include copper conductor pins with an insulator robust to the high pressure and high temperature of the operating conditions, such as a ceramic insulator. However, ceramic is less pliable than a thermoplastic insulator and may become stressed when the copper conductor pins expand due to high temperature and/or high pressure environments.

BRIEF DESCRIPTION OF THE DRAWINGS

For a detailed description of the embodiments of the invention, reference will now be made to the accompanying drawings in which.

DETAILED DESCRIPTION

Embodiments of the present disclosure provide a connector system with a feedthrough in which a conductor can move relative to an insulator, thereby relieving the stress on the insulator as the conductor expands due to high temperature or high pressure conditions.

Figure 1:
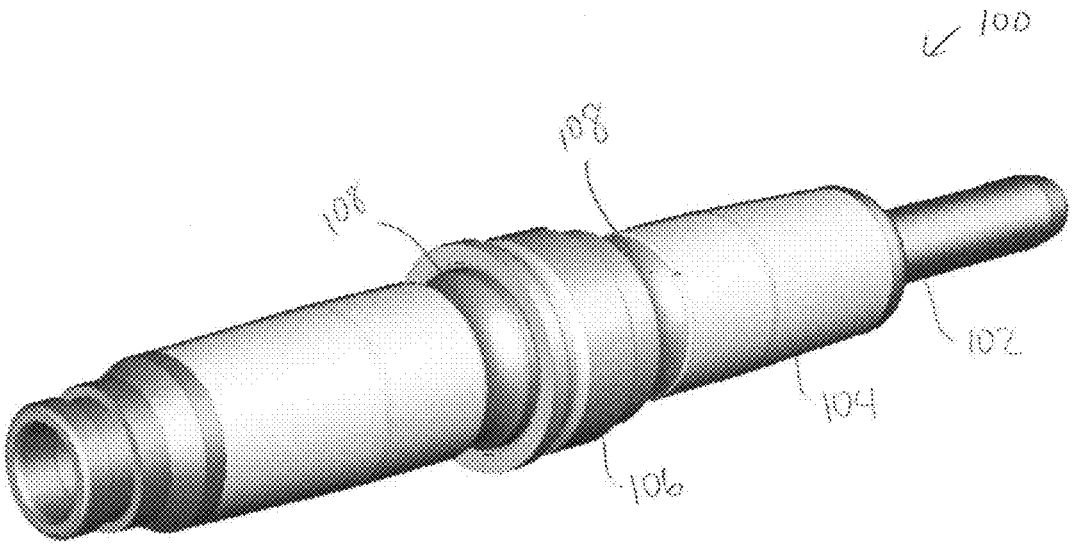
FIG. 1 depicts a perspective view of a feedthrough for a connector system, in accordance with one or more embodiments.

Referring to the drawings, FIG. 1 illustrates a perspective view of a feedthrough 100 for a connector system, in accordance with one or more embodiments. The feedthrough 100 includes a conductive pin 102 and an insulator 104 surrounding at least a portion of the conductor pin 102. In one or more embodiments, the feedthrough 100 includes a ring 106 around a portion of the insulator 104 for coupling the feedthrough 100 to a connector body or housing. The ring 106 may include grooves, threads, or ledges for mounting the feedthrough to a connector body or housing. The ring 106 may be attached via brazing, soldering, threads, or other means. In one or more embodiments, curved metalized grooves 108 on either side of the ring 106 enable to reduce the electrical stress gradient from the voltage field as it is inserted through a connector body or housing. The metalized grooves are curved to smooth out the voltage field gradient which converge as the field approaches the earth potential at the mounting ring 106 and metallic housing to which the pin is attached.

Figure 2:
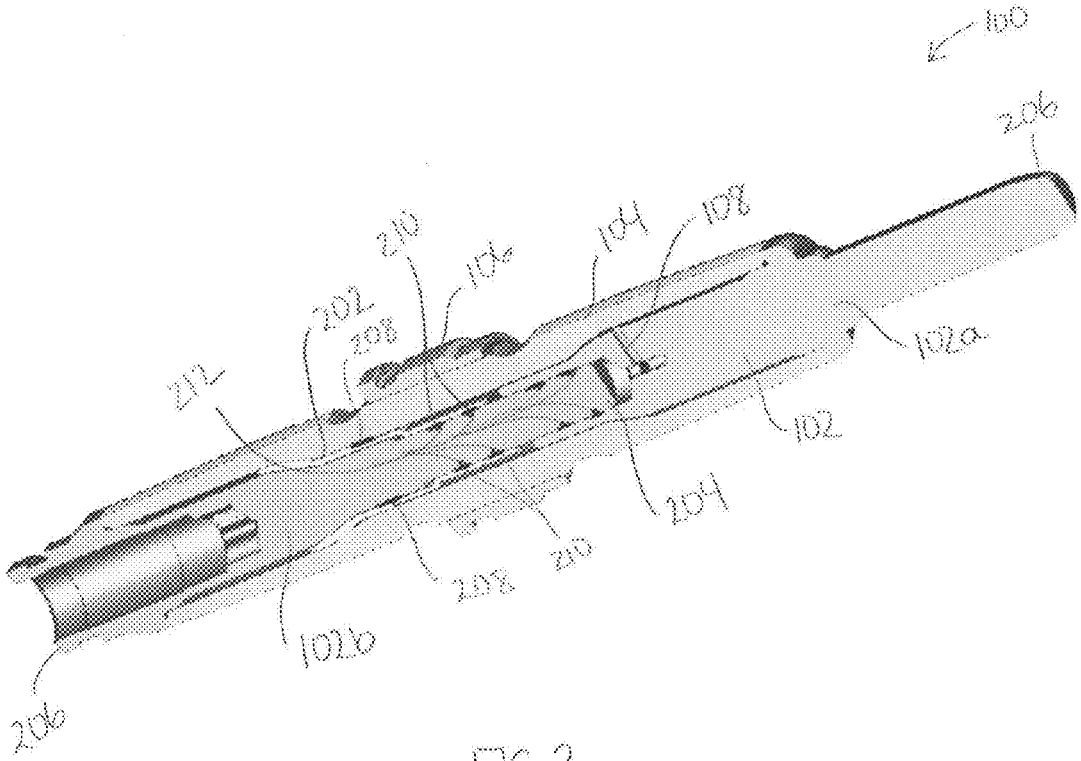
FIG. 2 depicts a cross-sectional view of the feedthrough, in accordance with one or more embodiments.

FIG. 2 illustrates a cross-sectional view of the feedthrough 100. The feedthrough 100 further includes a pressure sleeve 202 located between the insulator 104 and the conductor pin 102. The pressure sleeve 202 is coupled to the insulator 104 and the conductor pin 102 such that the conductor pin 102 is movable relative to the insulator 104 under thermal expansion. Typically, the conductor pin 102 material has a greater coefficient of thermal expansion than the insulator 104 material. Thus, under high temperature and/or high pressure conditions, the conductor pin 102 expands faster and more than the insulator 104. The pressure sleeve 202 provides compliance between the insulator 104 and the conductor pin 102 to alleviate stress that would otherwise by applied to the insulator, thereby maintaining integrity of the feedthrough. In one or more embodiments, the pressure sleeve 202 is designed to have a coefficient of thermal expansion matched to that of the insulator 104 so that the pressure sleeve 202 expands with the insulator 104 and absorbs the difference in expansion of the conductor pin 102. In one or more embodiments, there is space between the conductor pin 102 and the insulator 104 to allow the conductor pin to expand.

In embodiments, the pressure sleeve 202 may be brazed to the insulator 104 at some points or regions 208 on the pressure sleeve 202 and brazed to the conductor pin 102 at some other points or regions 210 on the pressure sleeve 202. This enables a degree of relative movement between the insulator 104 and the conductor pin 102 as the conductor pin 102 is not fixed directly to the insulator 104. In an embodiment the pressure sleeve is centrally located in a thick section of insulator 104 to provide a load bearing tapered region mounting position. More specifically, as the conductor pin 102 expands, the region of the pressure sleeve 202 coupled to the conductor pin 102 may be expanded as well. However, regions of the pressure sleeve 202 not coupled to the conductor pin 102, including regions which are coupled to the insulator 104, are not expanded by expansion of the conductor pin 102. Thus, the insulator is isolated from the expansion of the conductor pin 102. The pressure sleeve 202 may be fabricated from a nickel iron material or other materials having similar thermal expansion properties as ceramic. In one or more embodiments, the conductor pin 102 has grooves 212 for depositing brazing material. The pressure sleeve 202 and/or insulator 104 may also be formed with regions for depositing brazing material. In one or more other embodiments, the pressure sleeve 202 may be coupled to the insulator 104 and/or conductor pin 102 via another method, such as, but not limited to, soldering.

The insulator 104 may be fabricated from a ceramic material such as alumina or zirconia, among other insulator materials known to those skilled in the art. The insulator 104 is constructed in a tubular form with the conductor pin 102 inserted therethrough. The insulator 104 may have tapered inside and outside surfaces for voltage field management and mechanical loading requirements. Additionally, in one or more embodiments, the inside surface of the insulator 104 might be metalized to serve as a brazing substrate and a Faraday screen for the conductor pin 102.

The conductor pin 102 may be fabricated from a copper material such as copper chrome alloy or other suitable material known to those skilled in the art. The conductor pin 102 includes ends 206 that extend beyond the insulator 104 and that may be male ends, female ends, or a combination thereof. In one or more embodiments, the conductor pin 102 may include two conductor elements 102*a*, 102*b* joined together at a connection 204. The two conductor elements 102*a*, 102*b* may be brazed together, screwed together, joined as a capillary joint, among other coupling means to establish electrical conductivity therebetween.

In one or more embodiments, during brazing of the two conductor elements 102*a*, 102*b*, gases are released as the brazing material melts. In such embodiments, the conductor pin 102 has a vent port 108 formed therein. The vent port 108 may extend from the connection region 204 between the conductor elements 102*a*, 102*b* to outside of the conductor pin 102. The vent port 108 allows gases to escape and pressure to be alleviated during high temperature brazing so that the pressure does not compromise the brazing material as it hardens.

Figure 3:
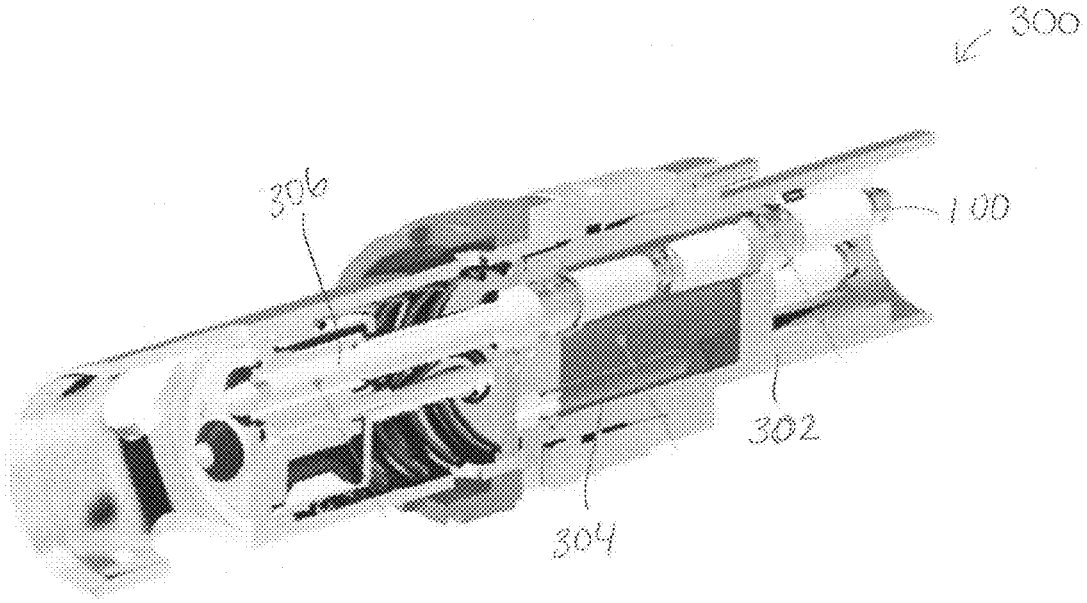
FIG. 3 depicts the feedthrough using in a wet mate connector, in accordance with one or more embodiments.

FIG. 3 illustrates the feedthrough 100 used in a connector system 300, such as a wet mate connector system, in accordance with one or more embodiments. The connector system 300 may be used, for example, in a tubing hanger penetration system for use with an electric submersible pump (ESP). The connector system 300 illustrates an example application of the ceramic feedthrough 100, but the ceramic feedthrough 100 may be used in a number of other applications. The connector system 300 includes a connector body 302 in which the feedthrough is held. The feedthrough 100 may be integrated in the connector system 300 as a pressure barrier system. In one or more embodiments, the connector system 300 includes a pressure compensating cavity 304 which may be filled with oil or other hydraulic fluids to compensate for pressure changes in the connector system 300. The feedthrough 100 may be electron beam welded to the connector body 302. The feedthrough 100 may be coupled to a contact pin such as a PEEK contact pin.

Figure 4:
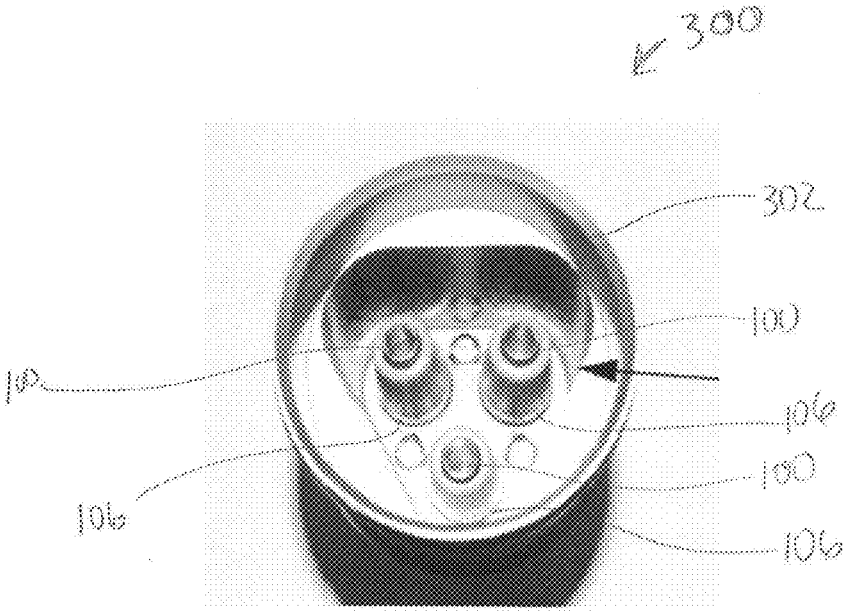
FIG. 4 depicts a front view of a of the wet mate connector, in accordance with one or more embodiments.

FIG. 4 illustrates an end of the connector system 300. The example connector system 300 includes three feedthroughs 100 mounted in the connector body 302 via the ring 106. The ring 106 may be fabricated from Inconel® and electron beam welded onto the connector body 302.

An example method of fabricating the feedthrough 100 includes placing brazing material on the insulator 104, the conductor pin 102, the pressure sleeve 202, or a subset thereof. The brazing material may be a brazing paste, a brazing ring, or the like. The conductor pin 102, the insulator 104, and the pressure sleeve 202 are then assembled and heated to melt the brazing material and braze the components together. This can be done in a single brazing step or in multiple stages using brazing materials with different melting points. The brazing operation may be done in a vacuum furnace in which the temperature may be raised to about 850° C. During the brazing process, gas may be vented from the conductor pin 102 through the vent ports 108, thereby alleviating pressure. In one or more embodiments, the conductor 102 may first be constructed by coupling the first conductor 102*a* to the second conductor 102*b* before brazing with the pressure sleeve 202.

This discussion is directed to various embodiments. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to intimate that the scope of the disclosure, including the claims, is limited to that embodiment.

Certain terms are used throughout the description and claims to refer to particular features or components. As one skilled in the art will appreciate, different persons may refer to the same feature or component by different names. This document does not intend to distinguish between components or features that differ in name but not function, unless specifically stated. In the discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. The use of "top," "bottom," "above," "below," and variations of these terms is made for convenience, but does not require any particular orientation of the components.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Although the present invention has been described with respect to specific details, it is not intended that such details should be regarded as limitations on the scope of the invention, except to the extent that they are included in the accompanying claims.

What is claimed is:

1. A feedthrough for a connector system, comprising:
- an insulator comprising a passage therethrough;
- a conductor pin located in the passage and movable relative to the insulator under thermal or pressure expansion or contraction; and
- a pressure sleeve coupled between the insulator and the conductor pin such that the pressure sleeve absorbs the expansion of the conductor pin.

2. The feedthrough of claim 1, wherein the conductor pin comprises two conductors joined together.

3. The feedthrough of claim 2, wherein the conductor pin comprises a vent port configured to dissipate gas and/or pressure.

4. The feedthrough of claim 2, wherein the two conductors are brazed together, screwed together, or form a capillary joint.

5. The feedthrough of claim 1, further comprising a threaded ring located around the insulator.

6. The feedthrough of claim 1, wherein the conductor pin comprises a female end, a male end, or both.

7. The feedthrough of claim 1, wherein the pressure sleeve is coupled to the insulator at a point or region on the pressure sleeve and to the conductor pin at a different point or region on the pressure sleeve.

8. The feedthrough of claim 1, wherein the insulator passage is metalized to serve as a Faraday screen and/or a brazing substrate.

9. The feedthrough of claim 1, wherein the pressure sleeve has a coefficient of thermal expansion matched to the insulator.

10. The feedthrough of claim 1, wherein the pressure sleeve comprises nickel iron.

11. A feedthrough connector system, comprising a connector body; and a feedthrough extending at least partially through the connector body, the feedthrough comprising:

an insulator comprising a passage therethrough;

a conductor pin located in the passage and movable relative to the insulator under pressure expansion or contraction; and a pressure sleeve coupled between the insulator and the conductor pin such that the pressure sleeve absorbs the expansion of the conductor pin.

12. The feedthrough of claim 11, wherein the feedthrough further comprises a ring formed around the insulator, and wherein the ring couples the feedthrough to the connector body.

13. The feedthrough of claim 12, wherein the ring is brazed to the insulator and electron beam welded to the connector body.

14. The feedthrough of claim 11, wherein the pressure sleeve is coupled to the insulator at a point or region on the pressure sleeve and to the conductor pin at a different point or region on the pressure sleeve.

15. The feedthrough of claim 11, wherein the conductor pin comprises two conductors joined together within the insulator.

16. The feedthrough of claim 15, wherein the conductor pin comprises a vent port configured to dissipate gas and/or pressure.

17. A method of fabricating a feedthrough, comprising:

placing brazing material on an insulator, a conductor pin, a pressure sleeve, or a subset thereof;

forming an assembly by arranging the conductor pin inside the insulator with the pressure sleeve between the conductor pin and the insulator; and heating the assembly to braze the conductor pin to the pressure sleeve and the pressure sleeve to the insulator.

18. The method of claim 17, further comprising venting gas or pressure from the conductor pin via a vent port in the conductor pin.

19. The method of claim 17, further comprising forming the conductor pin by coupling a first conductor to a second conductor.

20. The method of claim 17, wherein the conductor pin is movable relative to the insulator under thermal or pressure expansion or contraction.

* * * * *